US005918752A

United States Patent [19]

Meyer

[11] Patent Number: 5,918,752

[45] Date of Patent: Jul. 6, 1999

[54] TAMPER-EVIDENT SQUEEZE-AND-TURN CHILD-RESISTANT CLOSURE

[75] Inventor: Todd W. Meyer, Ottawa, Ohio

[73] Assignee: Owens-Illinois Closure Inc., Toledo, Ohio

[21] Appl. No.: 09/006,993

[22] Filed: Jan. 14, 1998

[51] Int. Cl.[6] ..... B65D 50/04

[52] U.S. Cl. ..... 215/204; 215/219; 215/250; 215/253; 215/277

[58] Field of Search ..... 215/216, 217, 215/218, 219, 221, 204, 250, 253, 330, 277, 278

[56] References Cited

U.S. PATENT DOCUMENTS

| | | | |
|---|---|---|---|
| 2,881,934 | 4/1959 | Rhodes . | |
| 2,964,206 | 12/1960 | Everett . | |
| 3,027,035 | 3/1962 | Farago . | |
| 3,394,830 | 7/1968 | Schiavo . | |
| 3,612,323 | 10/1971 | Malick . | |
| 3,822,805 | 7/1974 | Marchant . | |
| 3,868,036 | 2/1975 | Wittwer | 215/219 X |
| 3,870,182 | 3/1975 | Georgi | 215/220 |
| 3,888,375 | 6/1975 | Gerk . | |
| 3,896,335 | 7/1975 | Bogert | 215/219 |
| 3,915,326 | 10/1975 | Hrubesky | 215/219 |
| 3,946,889 | 3/1976 | Gach . | |
| 4,522,307 | 6/1985 | Steiner | 215/219 |
| 5,115,928 | 5/1992 | Drummond, Jr. | 215/219 |
| 5,445,283 | 8/1995 | Krautkramer | 215/219 X |
| 5,722,546 | 3/1998 | Briere | 215/221 X |

*Primary Examiner*—Stephen Cronin
*Assistant Examiner*—Nathan Newhouse

[57] ABSTRACT

A tamper-evident squeeze-and-turn child-resistant closure includes separate inner and outer caps each of integral monolithic plastic composition. The inner cap comprises a skirt with internal threads having application and removal lugs extending radially outwardly therefrom. The outer cap comprises an outer skirt having application lugs extending radially inwardly therefrom for engagement with the application lugs on the inner skirt to thread the closure onto a container. A pair of diametrically opposed tabs on the outer skirt have inwardly extending removal lugs for engagement with the removal lugs on the inner skirt to unthread the closure from the container. The tabs are resiliently joined at one end to the skirt, and are joined to the skirt at an opposing end by frangible links that rupture upon first inward movement of the tabs to indicate possible tampering with the closure.

15 Claims, 2 Drawing Sheets

TAMPER-EVIDENT SQUEEZE-AND-TURN CHILD-RESISTANT CLOSURE

The present invention is directed to closures for containers, and more particularly to closures that are constructed both to resist opening by a child and to indicate potential tampering with the closure arrangement.

BACKGROUND AND OBJECTS OF THE INVENTION

A number of child-resistant closure arrangements have been proposed in the art. Many of these arrangements require application of axial pressure on the closure system to open the container, which can be difficult for elderly persons. Closure systems that require radial squeezing pressure to open often embody one or more lugs or the like on the finish of the container, which is to say that the closure system is not self-contained. Arrangements to indicate potential tampering with the container and closure often embody application of tape to the closure skirt, or other secondary operations that can increase the cost of the overall closure and container system.

It is therefore a general object of the present invention to provide a tamper-evident child-resistant closure in which the child-resistance and tamper-evident features of the closure are embodied in the closure itself, which is to say that the (closure is self-contained, and which does not require additional secondary operations and/or modification of the container construction. Another object of the present invention is to provide a closure of the described character that is of squeeze-and-turn construction for removal of the closure, which is to say that the closure does not require downward or axial pressure on the closure to remove the closure from the container.

SUMMARY OF THE INVENTION

A tamper-evident child-resistant closure for a container having a finish with a threaded neck in accordance with a presently preferred embodiment of the invention includes an inner cap having a peripheral skirt with internal threads for receipt over the container neck, and an outer cap received over the inner cap and having a peripheral outer skirt surrounding the inner skirt. The outer skirt is interrupted by diametrically opposed tabs that are integrally coupled to the outer skirt for resilient inward movement to engage the inner skirt. The tabs are also coupled to the outer skirt by one or more frangible links in such a way that inward movement of the tabs to engage the inner skirt for removing the closure from the container ruptures the frangible links so as to indicate tampering with the closure. The closure is thus entirely self-contained, and is removed from the container by squeezing the opposed tabs radially inwardly without requiring axial pressure on the closure.

The inner cap has at least one pair of diametrically opposed removal lugs for engagement by the tabs on the outer cap. The inner cap also has at least one pair of diametrically opposed application lugs that are disposed for engagement with at least one pair of diametrically opposed application lugs on the outer cap. One set of application lugs, preferably the application lugs on the inner cap, is radially resilient, while the other set of application lugs has a camming surface for urging the resilient application lugs radially inwardly in the event that the outer cap is rotated counterclockwise with respect to the inner cap. Thus, the application lugs abut each other for rotating the closure clockwise onto a container, and the outer cap is freely rotatable counterclockwise until the diametrically opposed tabs are urged radially inwardly to engage the removal lugs on the inner cap.

The inner skirt on the inner cap has an open end with a radially outwardly projecting flange. The open end of the outer cap has a radially inwardly projecting rib that is received over the peripheral edge of the inner skirt flange for retaining the outer cap on the inner cap. Circumferential bearings on the closed ends of the inner and outer cap maintain rotational alignment of the inner and outer cap. Strengthening ribs extend from the inner skirt to the flange of the inner cap in the preferred embodiment of the invention.

In accordance with another aspect of the present invention, there is provided a method of indicating tampering with a child-resistant closure that includes an inner cap having a peripheral inner skirt with means for fastening to a container. An outer cap is received over the inner cap and has a peripheral outer skirt surrounding the inner skirt, with at least one tab resiliently flexibly coupled thereto for motion inward under force to engage the inner skirt. The method of indicating tampering with the closure is accomplished by coupling the tab to the outer skirt by one or more frangible links that are ruptured by first inward motion of the tab so that tampering with the tab and closure is evident from inspection of the frangible links.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
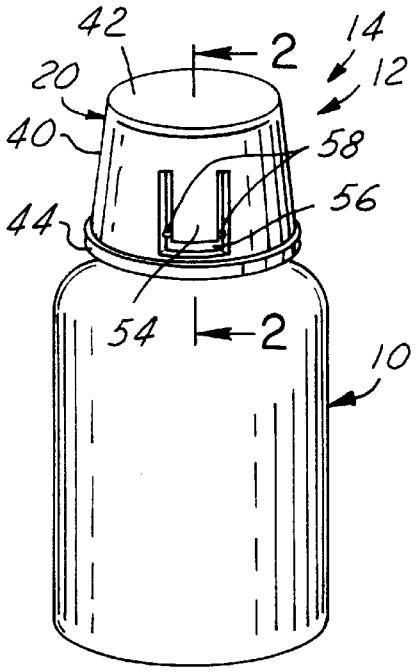
FIG. 1 is a perspective view of a container and closure system in accordance with one presently preferred embodiment of the invention.
Figure 2:
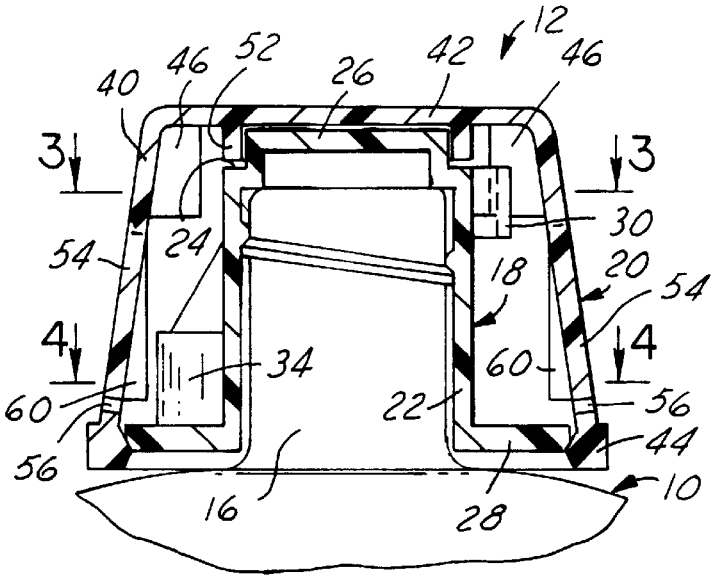
FIG. 2 is a fragmentary sectional view of the container and closure of FIG. 1 taken substantially along the line 2—2 in FIG. 1.

FIG. 1 illustrates a container 10 and a closure assembly 12 that are assembled to each other to form a container and closure system 14 in accordance with one presently preferred embodiment of the invention. Referring to FIG. 2, container 10 has a finish with an externally threaded substantially cylindrical neck 16 and an open mouth for affording access to the inside of the container. Closure assembly 12 includes an inner cap 18 and an outer cap 20, each of one-piece monolithically integral molded plastic composition, such as polypropylene, for example.

Figure 3:
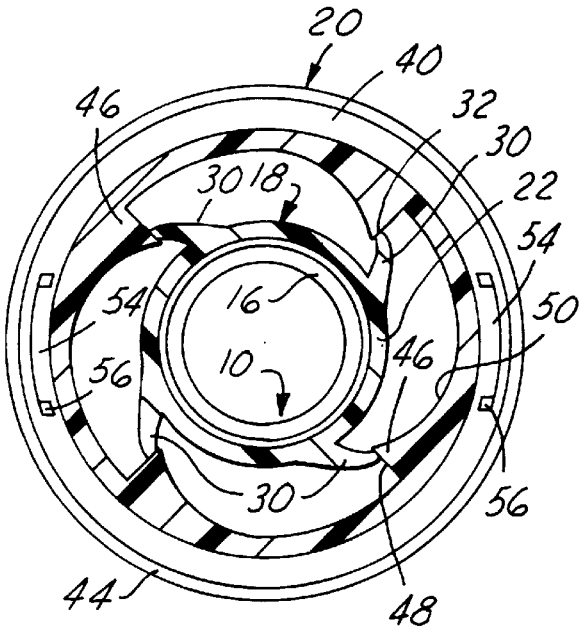
FIGS. 3 and 4 are sectional views taken substantially along the lines 3—3 and 4—4 in FIG. 2.
Figure 8:
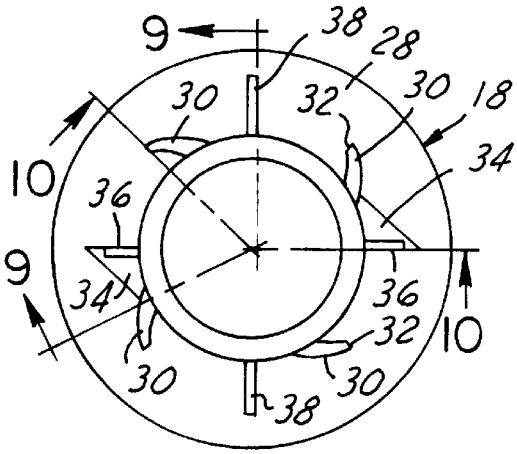
FIG. 8 is a top plan view of the inner cap of the closure of FIGS. 1–4.
Figure 9:
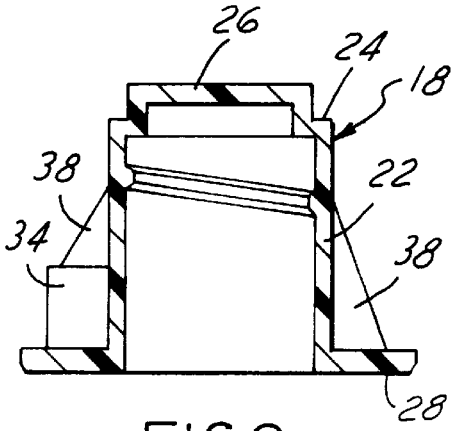
FIGS. 9 and 10 are sectional views taken substantially along the respective lines 9—9 and 10—10 in FIG. 8.
Figure 10:
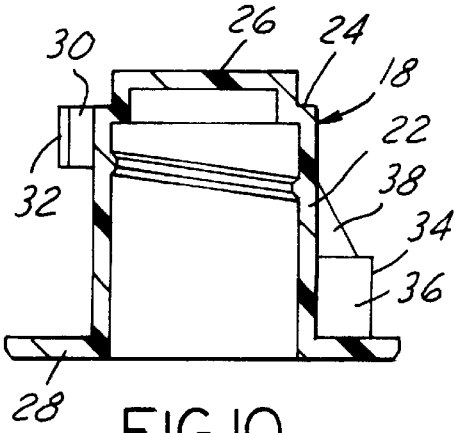

Inner cap 18 (FIGS. 2–4 and 8–10) includes a substantially cylindrical inner skirt 22 having internal threads for receipt over the external threads on neck 16 of container 10. The closed upper end of skirt 22 is formed by an annular peripheral step 24 from which a cylindrical boss 26 axially extends. (Directional adjectives such as "upper" and "lower" are taken with respect to the vertical orientation of the container and closure system illustrated in FIGS. 1 and 2.) A flange 28 extends radially outwardly from the lower open end of skirt 22 and is circumferentially continuous around inner cap 18, as best seen in FIG. 8. Four application lugs 30 extend radially outwardly from inner skirt 22 adjacent to the closed upper end thereof in orthogonal diametrically opposed pairs, as best seen in FIGS. 3 and 8. Each lug 30 extends at a counterclockwise angle from skirt 22, tapers narrowingly outwardly from skirt 22, and terminates in a tangentially counterclockwise-oriented abutment face 32. A pair of diametrically opposed removal lugs 34 extend radially outwardly from the lower end of skirt 22, and are integrally joined to flange 28. Each removal lug 34 has a flat abutment face 36 that faces tangentially clockwise from skirt 22. Two pair of diametrically opposed strengthening ribs 38 extend from skirt 22 downwardly and outwardly to flange 28 for firmly supporting flange 28 with respect to skirt 22.

Figure 4:
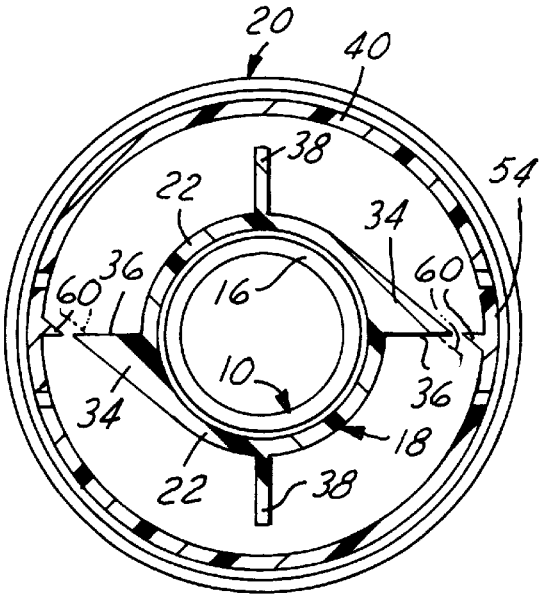
Figure 5:
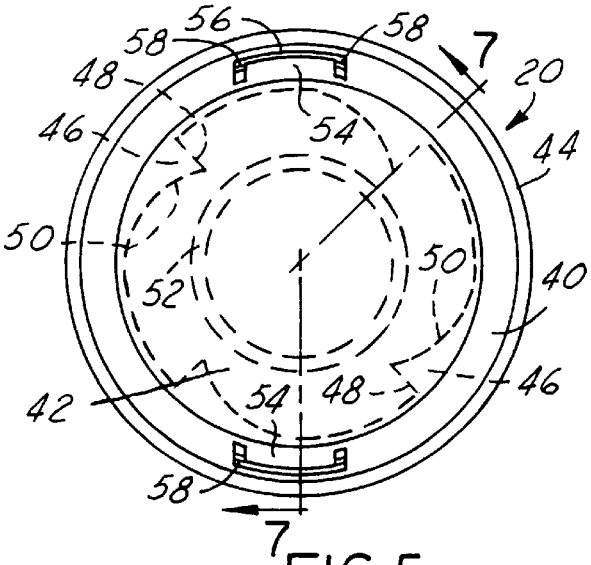
FIG. 5 is a top plan view of the outer cap in the closure of FIGS. 1–4.
Figure 7:
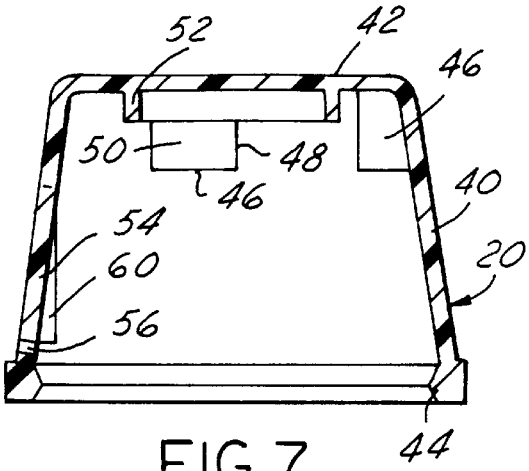
FIG. 7 is a sectional view taken substantially along the line 7—7 in FIG. 5.
Figure 6:
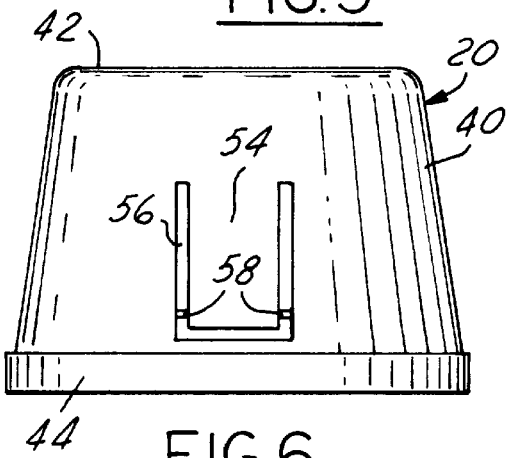
FIG. 6 is a side elevational view of the outer cap of FIG. 5.

Outer cap 20 (FIGS. 2–7) is also of monolithically integral composition, and includes a generally conical skirt 40 having a closed flat upper end 42 and an open lower end surrounded by a radially inwardly projecting rib 44. Four application lugs 46 are disposed in diametrically opposed orthogonal pairs (as best seen in FIGS. 3 and 5) that extend radially inwardly from the upper end of skirt 40 adjacent to end 42. Each lug 46 has a flat abutment surface 48 that faces tangentially clockwise, and a concave canmming surface 50 that is oriented radially and tangentially counterclockwise. An annular bearing shoulder 52 extends inwardly and downwardly from closed end 42 coaxially with skirt 40. A pair of diametrically opposed tabs 54 each have an upper end integrally joined to skirt 40. The circumferentially spaced side edges and the bottom edge of each tab 54 are spaced from the adjacent edges of skirt 40, which is to say that tab 54 is surrounded on three sides by a gap 56 that separates the tab from the adjacent body of skirt 40. A pair of circumferentially aligned and circumferentially oriented frangible links 58 integrally couple tab 54 to skirt 40 adjacent to the lower free end of tab 54, as best seen in FIGS. 1 and 6. Skirt 40 may include external knurling or ribs as desired to facilitate gripping of the outer cap during rotation, and tabs 54 may include suitable indicia such as "push here" to advise how the closure is to be opened. Each tab 54 carries a pair of circumferentially spaced inwardly projecting removal lugs 60 that extend radially inwardly from the opposed side edges of the tab (FIG. 4). In assembly, removal lugs 60 are normally radially spaced from removal lugs 34 on inner cap 18, as shown in solid lines in FIG. 4.

In assembly, outer cap 20 is aligned with and axially received over inner cap 18 until rib 44 on skirt 40 snaps over the outer peripheral edge of flange 28, which retains outer cap 20 in assembly over inner cap 18. Boss 26 is circumferentially slidably received within annular shoulder 52, with these elements cooperating in assembly to maintain axial alignment of the inner and outer caps during rotation, and thereby preventing application of bending stresses on flange 28. To assemble closure 12 to a container 10, the open lower end of inner cap 18 is placed over the open upper end of container neck 16, and outer cap 20 is rotated clockwise. During such clockwise rotation, clockwise-oriented faces 48 of application tabs 46 on outer cap 20 are brought into circumferential abutment with counterclockwise-oriented faces 32 of application tabs 30 on inner cap 18, as best shown in FIG. 3. Continued clockwise rotation of outer cap 20 thus rotates inner cap 18 and threads inner cap 18 onto finish neck 16 of container 10. Outer cap 20 is carried onto the container by means of rib 44 in abutment with flange 28. Such clockwise rotation is continued until the closure assembly 12 is snugly assembled to the container. The inner axial face of step 24 seats against the axial edge of neck 10 (FIG. 2).

To remove closure 12 from container 10, tabs 54 on outer skirt 40 are manually urged radially inwardly to a position shown in phantom in FIG. 4, in which removal lugs 60 on tabs 54 are disposed at radii for circumferential abutment with faces 36 on removal lugs 34 of inner cap 18. Such inward motion of tabs 54 ruptures frangible links 58. Such rupture of links 58 provide a ready visual indication observable by a user that opening and removal of closure 12 has been attempted at least once. With tabs 54 held radially inwardly, outer cap 20 is rotated counterclockwise, which rotates inner cap 18 counterclockwise through abutment of lugs 60 and 34, which removes the closure assembly from the container. The closure may thereafter be repeatedly threaded onto and off of the container by the consumer. It will be noted that application and removal of the closure does not require application of axial force on the closure. In the event that outer cap 20 is rotated counterclockwise without moving tabs 54 and lugs 60 radially inwardly, lugs 60 rotate past lugs 34 without abutting engagement. In the meantime, lugs 30 on inner cap 18 are cammed radially inwardly by surfaces 50 of lugs 46. After lugs 30 clear lugs 46, lugs 30 resiliently return to the position shown in FIG. 3.

I claim:

1. A tamper-evident child-resistant closure for a container having a threaded neck that comprises:

an inner cap having an inner skirt with internal threads for receipt over the container neck, and an outer cap received over said inner cap and having a peripheral outer skirt surrounding said inner skirt, said outer skirt being interrupted by diametrically opposed tabs with means coupling said tabs to said outer skirt for resilient inward movement to engage said inner skirt and means frangibly coupling said tabs to said outer skirt such that inward movement of said tabs to engage said inner skirt ruptures said frangibly coupling means to indicate tampering with the closure, said tabs each have one axial end integrally resiliently joined to said outer skirt, and a second axial end and circumferentially spaced side edges spaced from said outer skirt, and wherein said frangible coupling means comprises a pair of circumferentially extending and circumferentially aligned links disposed adjacent to said second ends of said tabs, each integrally joining one of said side edges of said tab to an adjacent portion of said outer skirt.

2. The closure set forth in claim 1 wherein said inner cap has diametrically opposed removal lugs for engagement by said tabs.

3. The closure set forth in claim 2 wherein said tabs have radially inwardly extending removal lugs for engagement with said removal lugs on said inner cap.

4. The closure set forth in claim 1 wherein said inner cap has at least one pair of diametrically opposed application lugs extending radially outwardly from said inner skirt, and wherein said outer cap has at least one pair of diametrically opposed application lugs extending radially inwardly from said outer skirt for engagement with said application lugs on said inner cap.

5. The closure set forth in claim 4 wherein said application lugs on one of said inner and outer caps are radially resilient, and wherein the application lugs on the other of said inner and outer caps include cam means for camming said application lugs on said one of said inner and outer caps radially upon counterclockwise rotation of said outer cap with respect to said inner cap.

6. The closure set forth in claim 1 wherein said inner skirt on said inner cap has an open end with a radially outwardly projecting flange, and wherein said outer skirt on said outer cap has a radially inwardly extending rib that is received by snap fit over said flange to secure said outer cap to said inner cap.

7. The closure set forth in claim 6 wherein said inner cap includes strengthening ribs extending from said inner skirt to said flange.

8. The closure set forth in claim 6 wherein said outer cap has a closed end spaced from said rib, and wherein said inner cap has a closed end spaced from said flange, said closed ends of said inner and outer caps having opposed bearing means for maintaining alignment between said inner and outer caps.

9. A tamper-evident child-resistant closure for a container having a threaded neck that comprises:

an inner cap having an inner skirt with internal threads for receipt over the container neck and at least one pair of diametrically opposed application lugs extending radially outwardly from said inner skirt, and an outer cap received over said inner cap, and having a peripheral outer skirt surrounding said inner skirt and at least one pair of diametrically opposed application lugs extending radially inwardly from said outer skirt for engagement with said application lugs on said inner cap, said outer skirt being interrupted by diametrically opposed tabs with means coupling said tabs to said outer skirt for resilient inward movement to engage said inner skirt and means frangibly coupling said tabs to said outer skirt such that inward movement of said tabs to engage said inner skirt ruptures said frangibly coupling means to indicate tampering with the closure, said application lugs on one of said inner and outer caps being radially resilient, and said application lugs on the other of said inner and outer caps including cam means for camming said application lugs on said one of said inner and outer caps radially upon counterclockwise rotation of said outer cap with respect to said inner cap.

10. The closure set forth in claim 9 therein said tabs each have one axial end integrally resiliently joined to said outer skirt, and a second axial end and circumferentially spaced side edges spaced from said outer skirt, and wherein said frangible coupling means comprises at least one link integrally joining one of said spaced edges of said tab to an adjacent portion of said outer skirt.

11. The closure set forth in claim 10 wherein said frangible coupling means comprises a pair of links integrally joining said side edges of said tab to said outer skirt.

12. The closure set forth in claim 11 wherein said pair of links are circumferentially aligned.

13. The closure set forth in claim 12 wherein said links are disposed adjacent to said second ends of said tabs.

14. The closure set forth in claim 9 wherein said radially resilient application lugs are disposed on said inner cap and said application lugs with said cam means are disposed on said outer cap.

15. The closure set forth in claim 14 wherein there are two pair of application lugs on both said inner and outer caps disposed 90° from each other.

* * * * *